United States Patent [19]

Abercrombie

[11] 4,275,790

[45] Jun. 30, 1981

[54] SURFACE CONTROLLED LIQUID REMOVAL METHOD AND SYSTEM FOR GAS PRODUCING WELLS

[75] Inventor: Bolling A. Abercrombie, Houston, Tex.

[73] Assignee: McMurry-Hughes, Inc., Huntsville, Tex.

[21] Appl. No.: 91,035

[22] Filed: Nov. 5, 1979

[51] Int. Cl.[3] ..... E21B 43/12

[52] U.S. Cl. ..... 166/314; 166/53; 166/64; 166/105.5

[58] Field of Search ..... 166/314, 53, 64, 105.5, 166/106, 107, 68, 65 R, 267, 265

[56] References Cited

U.S. PATENT DOCUMENTS

| | | | |
|---|---|---|---|
| 1,674,815 | 6/1928 | Barnhart | 166/105.5 |
| 1,949,323 | 2/1934 | Otis | 166/314 |
| 2,293,196 | 8/1942 | Crump | 166/314 X |
| 2,349,164 | 5/1944 | Gilbert | 166/105.5 X |
| 2,883,940 | 4/1959 | Gibson | 166/105.5 |
| 4,150,721 | 4/1979 | Norwood | 166/314 X |
| 4,187,912 | 2/1980 | Cramer | 166/314 |

*Primary Examiner*—Stephen J. Novosad

*Attorney, Agent, or Firm*—Robert A. Felsman

[57] ABSTRACT

Production equipment for oil and gas wells has features that allow accumulated liquid to be removed from the well without the need for a low pressure system. This equipment also isolates the perforations from accumulated liquid back pressure, even if there is insufficient hole depth below the perforations. The well has a tubing string located inside the casing, with the tubing in contact with the accumulated liquid. Both the tubing and the casing are connected to the sales line. Periodically, both the casing and tubing are shut-in, allowing formation pressure to build up in the casing. Then the tubing is opened to the sales line to discharge its accumulated liquid, it being driven by the higher formation pressure that has built up. To isolate the perforations from accumulated liquid, a standpipe is mounted in the casing above the perforations by a packer. The standpipe receives the lower end of the tubing which is closed except for a passage connecting it to the annular area between the standpipe and the casing. Produced fluid flows up the standpipe in a restricted area adjacent the tubing. At the top of the standpipe, liquid droplets drop out and accumulate above the packer between the standpipe and the casing.

5 Claims, 6 Drawing Figures

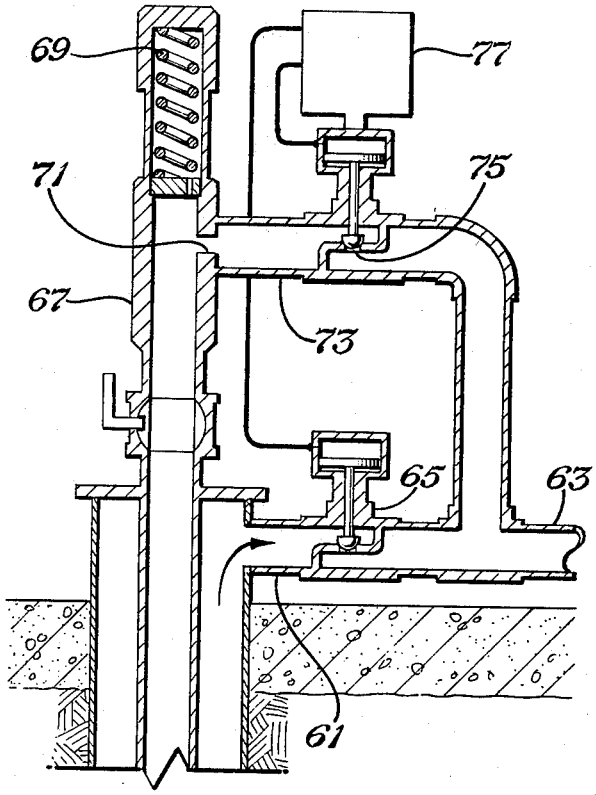
Fig. 1a
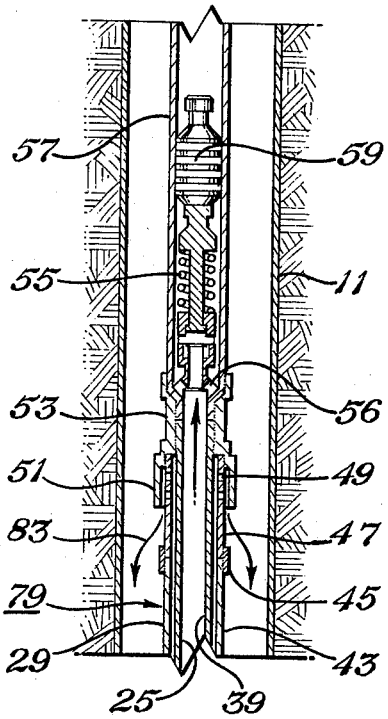
Fig. 1b
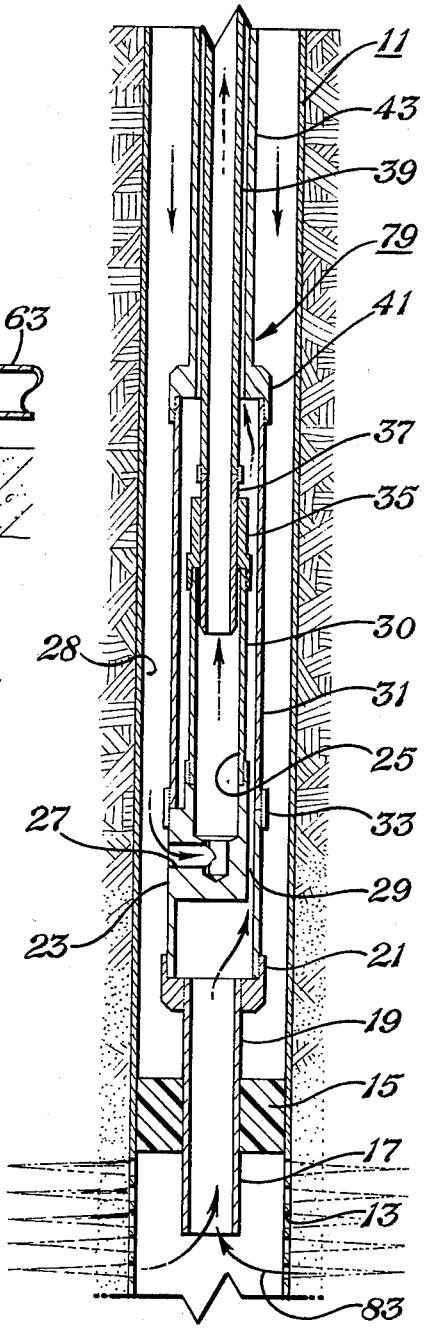

SURFACE CONTROLLED LIQUID REMOVAL METHOD AND SYSTEM FOR GAS PRODUCING WELLS

BACKGROUND OF THE INVENTION

1. Field of the Invention

This invention relates in general to oil and gas well production, and in particular to a system for removing accumulated liquid from gas producing wells.

2. Description of the Prior Art

Many gas wells product both gas and liquids such as water, oil and condensate. The gas is often flowed from the casing to a sales line. Part of the liquid, initially entrained as droplets in the gas flow, drops out of the flow because of insufficient velocity of gas. The liquid accumulates in the bottom of the well, and as accumulation increases, exerts an increasingly large back pressure on the formation. This back pressure, which equals the hydrostatic head of the liquid column, may be large enough to reduce the production rate or completely stop production.

It is therefore advantageous to periodically remove accumulated liquid from gas wells. A typical gas well has casing through which the gas flows through the perforations at the gas producing formation to a production or sales line at the surface or well head. Tubing inside the casing is used to remove accumulated liquids. The tubing usually has an open lower end extending close to the producing formation and into the accumulated liquid. Normally, the tubing is closed by the valve at the surface, and the casing is opened to permit gas to flow into the sales line. Accumulated liquid rises in the casing and in the tubing to the same level. To remove liquid the valve at the top of the tubing is opened to reduce the pressure inside the tubing to a value less than the pressure inside the casing and in the sales line. Thus, the pressure of the gas inside the casing forces liquid through the tubing toward the well head. The liquid and gas from the tubing is discharged into a low pressure storage and disposal system.

In the above method, liquid removal is facilitated by use of a loose fitting plunger which separates the liquid and the gas. This helps prevent the gas from migrating through the liquid and prevents the liquid from dropping through the gas.

There are a number of variations of the above described methods. Two such variations may be seen in U.S. Pat. Nos. 3,053,188 and 3,203,351. One disadvantage of such systems is that they require a second pipe system on the surface leading to the lower pressure storage or disposal facility. This represents a considerable additional amount of pipe and equipment that must be installed and maintained. Also, the gas discharged in the lower pressure system may not be usable unless pressurized to the sales line pressure, which may not be economical.

SUMMARY OF THE INVENTION

It is accordingly the general object of this invention to provide an improved system for removing accumulated liquid from gas producing wells.

It is a further object of this invention to provide an improved system for removing accumulated liquids from gas producing wells that does not require a low pressure surface system.

It is a further object of this invention to provide an improved system for removing accumulated liquids from gas producing wells that avoids back pressure on the formation as the liquid accumulates.

As in the prior art, a system is provided in which gas is produced through the casing. A string of tubing is located in the casing, with its lower end adapted to be close to the producing formation and in communication with the accumulated liquid. Unlike the prior art systems, however, the tubing is also connected to the sales line, not to a low pressure system. During gas producing operations, both the tubing and casing communicate with the sales line and have the same pressure.

As in the prior art liquid will accumulate in the tubing, and the gas will be produced from the casing. Periodically, both the tubing and casing are closed to the sales line. Formation pressure will build up in the casing, causing the liquid in the tubing to rise. Then only the tubing is opened to the sales line. Casing gas at the build-up pressure will force the liquid into the sales line. Once discharged, the casing is again opened to the sales line to repeat the cycle.

If sufficient well depth is exists below the perforations, liquid may accumulate therein to avoid back pressure on the perforations. If not, a packer is set above the perforations in the casing. The lower end of the tubing is closed to upwardly flowing fluid and located in a standpipe above the packer. The produced gas from the formation flows through the tail pipe, the annular area between the standpipe and the tubing, then into the annular area between the casing and the tubing. The standpipe and tubing annular area creates a restricted flow passage for the fluid, resulting in higher velocities and improved liquid entrainment. Once discharged from the standpipe, the velocity reduces, and entrained liquid drops out to accumulate on the packer between the casing and the standpipe. This isolates the accumulated liquid from the perforations. A passage communicates the lower end of the tubing with the space between the standpipe and casing, allowing the accumulated liquid to flow into the tubing. Preferably a plunger is located in the tubing to facilitate liquid removal.

BRIEF DESCRIPTION OF THE DRAWINGS

FIGS. 1*a* and 1*b* are partial schematic representations of a system constructed in accordance with this invention.

DESCRIPTION OF THE PREFERRED EMBODIMENT

Figure 2:
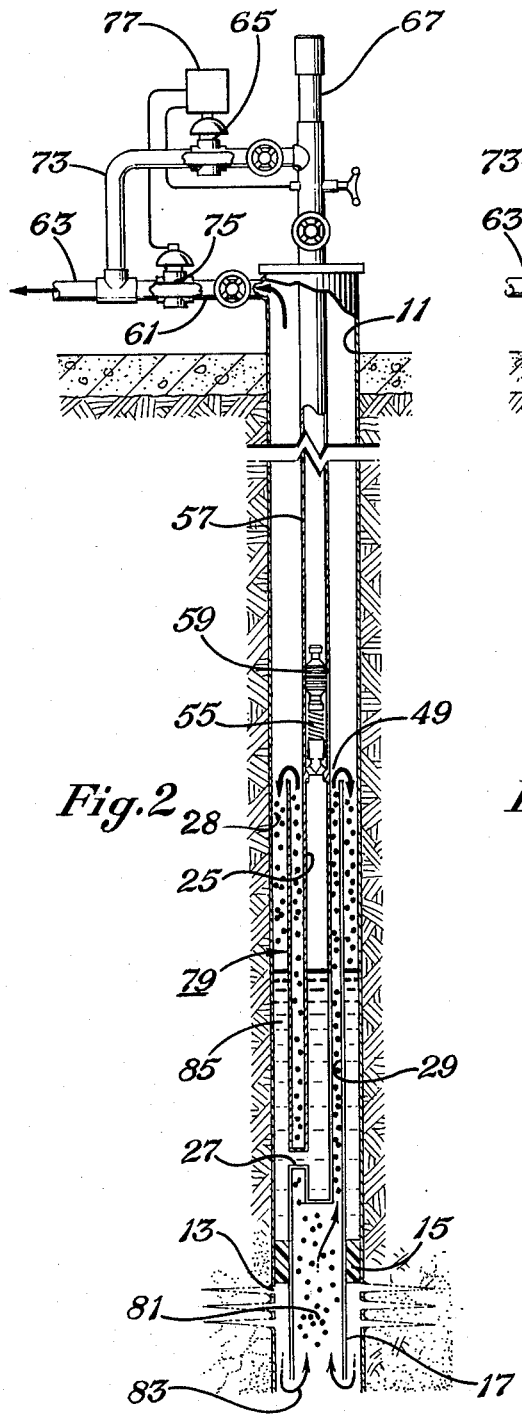
FIG. 2 is a schematic in reduced scale of the system of FIG. 1, further simplified and shown in the gas producing mode.

Referring to FIG. 1*b*, the system includes a conventional casing 11. Casing 11 comprises sections of metal pipe lowered into the well and set by cement pumped up the annular space between the pipe and the borehole wall for a selected distance. Perforations 13 are subsequently made by shaped explosives in the casing, annuar cement portion, and formation, to allow fluid from the desired earth formation to be produced.

In the preferred embodiment, a packer 15 is set above the perforations 13. Packer 15 has an annular resilient member that seals against casing 11. Packer 15 has an inner flow passage, and a tail pipe 17 extends downwardly from packer 15 for a shortdistance. A section of pipe or pup joint 19 extends upwardly from packer 15. A collar 21 connects pup joint 19 to a mandrel 23. Mandrel 23 is a member having a longitudinal internal passage 25 with a closed lower end. A lateral passage 27 in mandrel 23 leads from the bottom of passage 25 to the space between mandrel 23 in casing 11, defined herein as part of a collection chamber or area 28. Mandrel 23 also has a longitudinal flow passage 29 separate from passage 25. Mandrel 23 has a reduced diameter threaded upper portion connected to a pup joint 30.

A section of pipe or pup joint 31 is secured to the large diameter portion of mandrel 23 by collar 33. Pup joint 31 extends upwardly, surrounding the upper portion of mandrel 23, pup joint 30, in a continuation of flow path 29. The area surrounding pup joint 31 is also part of the collection chamber 28. The top of pup joint 30 is secured to a stinger receiver 35. A stinger 37 inserts in stinger receiver 35 and extends upwardly, the receiver 35 having an inner bore continuing passage 25. A section of tubing 39 is secured to stringer 37, it having a longitudinal bore continuing passage 25.

Pup joint 31 is secured by a collar 41 to a section of tubing 43 of larger diameter than tubing 39. The annular space between tubing 39 and tubing 41 continues the flow path passage 29. Referring to FIG. 1*a*, tubing 43 is secured by a collar 45 to a pup joint 47 having opening 49 at its top. Opening 49 serve as the upper open or discharge end of the flow path passage 29. A deflector 51 surrounds openings 49 a selected annular distance from them. Tubing 39 is secured to a receiver nipple 53.

A bumper spring assembly 55 is located on top of receiver nipple 53. The annular space around bumper spring 55 and a set of ports 56 in receiver nipple 53 at the base of the bumper spring 55, continue the passage 25. The lower end of a string of tubing 57 is secured to the receiver nipple 53. A conventional plunger 59, such as shown in U.S. Pat. Nos. 3,053,188, and 3,203,351, is located in tubing 57 and adapted to rest in its lower position on bumper spring 55. Plunger 59 is loosely carried in tubing 57, and is sized so as to allow a low flow rate of gas and liquid past it. It does not form a tight seal with tubing 57, but a sufficient velocity of fluid up tubing 57 will move plunger 59 upward, as is well known in the art.

At the top of the well, a conduit 61 connects the top of casing 11 to the sales line 63. Sales line 63 is the line leading to the processing equipment for the gas, and is maintained at a pressure that may be from 150 psi to 800 psi (pounds per square inch) or more. A valve 65 opens and closes conduit 61. The top of tubing 57 is connected to a lubricator 67. Lubricator 67 receives plunger 59. Lubricator 67 has a bumper string 69 at its top to absorb shock when the plunger 59 strikes the top. A port 71 on the side of the lubricator 67 is adapted to be closed by plunger 59 when in the lubricator. A conduit 73 leads from port 71 to the sales line 63, downstream of valve 65. Conduit 73 serves as a connection means for connecting the tubing 57 to the sales line 63. A valve 75 opens and closes conduit 73. Control circuit 77 pneumatically opens and closes the valves 65 and 75.

The mandrel 23, pup joint 31, collars 33 and 41, tubing 43, collar 45, pup joint 47, and deflector 51 make up an assembly that may be referred to collectively as a standpipe 79. Standpipe 79 is shown schematically in FIGS. 2–5. The lower end of production tubing 57 will be defined herein to include passage 25 in mandrel 23, pup joint 30, stinger receiver 35, stinger 37 and tubing 39. The lower end of tubing 57 will be considered the lower end of longitudinal passage 25. The lower end of tubing 57 is closed to fluid coming up the tail pipe 17, but is open to fluid in the collection area surrounding the standpipe 79 and above packer 15 through lateral passage 27.

In operation, referring to FIG. 2, gas is produced by opening both valves 65 and 75. Gas and entrained liquid droplets, indicated by the dotted areas 81, will flow from perforations 13 into tail pipe 17, as shown by arrows 83. The gas and liquid mixture will flow into the restricted flow path 29. The lesser cross-sectional area of flow passage 29 as compared to casing 11 diameter, increases the velocity of the fluid. The higher velocity prevents a substantial amount of the droplets from falling out of the flow. At the top of the standpipe 79, the flow discharges through openings 49 and enters casing 11 surrounding tubing 57. The larger flow path in casing 11 decreases the velocity of the fluid, casing liquid to drop from the flow and fall by gravity onto the packer 15. The gas continues to flow to the top of casing 11, through conduit 61 and into sales line 63.

As the liquid accumulates in the collection area 28, it will proceed through lateral passage 27 into passage 25 as indicated by the shaded areas 85. The pressure will vary per well, but in general in a gas well, the bottom hole pressure will be only slightly greater than the pressure at the top of the well since the gas and droplets in casing 11 will have little hydrostatic weight. The pressure at the sales line 63 will be substantially the same as the pressure at the top of tubing 57 and at the top of casing 11. There will be no flow through tubing 57 to sales line 63 since no pressure differential on liquid 85 exists to force the liquid up. The equal pressure above liquid 85 in passage 25 of tubing 57 and above liquid 85 in the collection area 28 of casing 11, causes the columns in these respective areas to be at the same vertical level. The perforations 13 will be isolated from the hydrostatic head of the accumulated liquid 85. The standpipe length, typically about 100 feet, will allow a substantial column of liquid to build up. The well may be several thousand feet deep, thus the standpipe length is much less.

Figure 3:
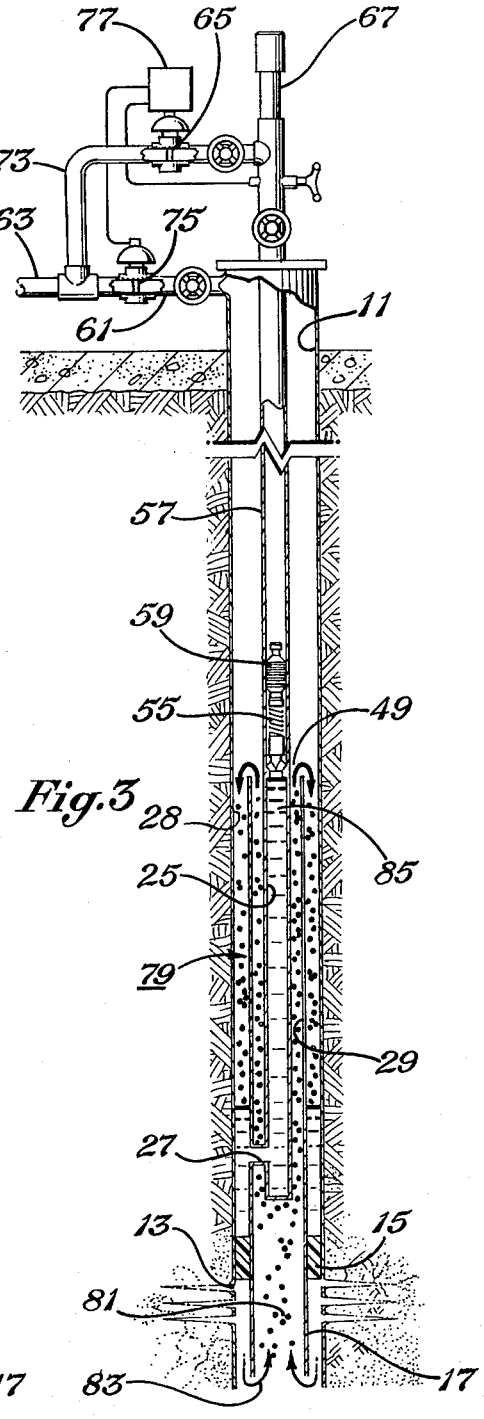
FIG. 3 is a schematic in reduced scale of the system of FIG. 1, further simplified and shown in the shut-in mode.

Once the accumulated liquid 85 reaches a selected level, both valves 65 and 75 will be shut-in, as indicated in FIG. 3. The time for shutting these valves is determined empirically on a well to well basis, but the shut-in should be before the liquid column 85 reaches the top of the standpipe 79. Once determined for a well, a timer in the control circuit 77 will cause the closure of valves 65 and 75. When shut-in, formation pressure in casing 11 will build up from the flowing pressure in line 63 toward a shut-in pressure. During build-up, fluid will continue to flow from perforations 13, up flow passage 29, and out openings 49 at the top of standpipe 79. As the casing 11 pressure builds up, it will force the level of liquid 85 down in the collection chamber 28, the liquid proceeding through lateral passage 27 into longitudinal passage 25. The level in passage 25 will rise, with some of the liquid possibly flowing past plunger 59.

Figure 4:
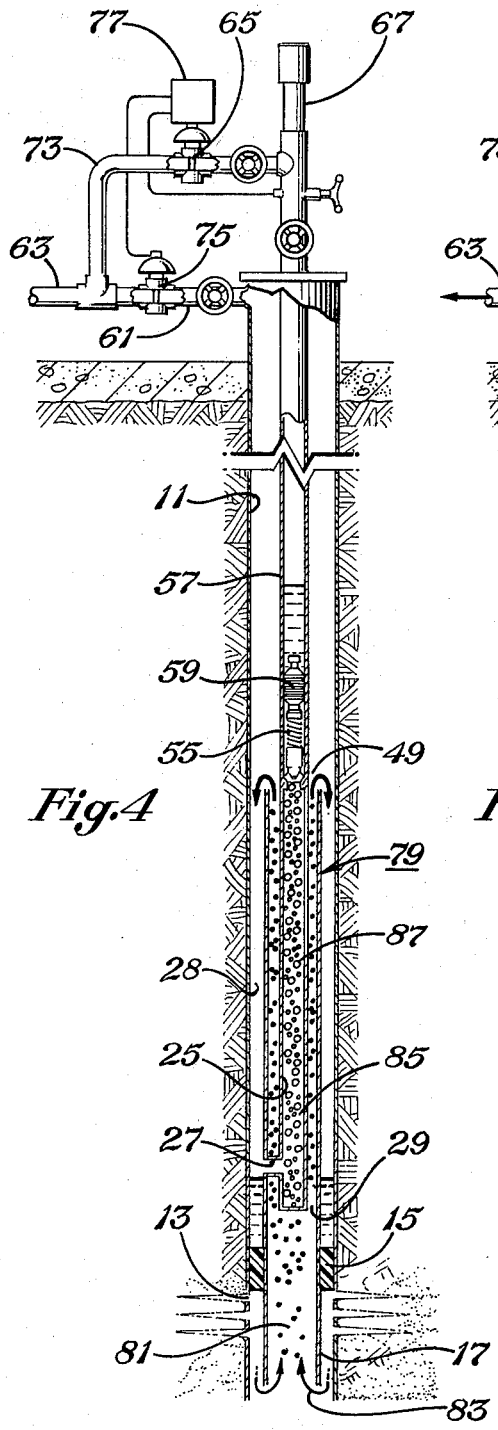
FIG. 4 is a schematic reduced scale of the system of FIG. 1, further simplified and shown in the shut-in mode at a time subsequent to the mode as shown in FIG. 3.

FIG. 4 illustrates continuing formation pressure build-up. In the collection chamber 28, the fluid level will drop down to the level of lateral passage 27. Gas bubbles, indicated as numeral 87, will migrate up the column of liquid 85 and past plunger 59 to enter the gas above the column. Additional liquid 85 will also flow slowly past plunger 59. The pressure above liquid 85 in tubing 57 will be the same as the pressure in the casing 11 collection chamber 28, less the pressure due to the hydrostatic weight of the liquid column 85. For example, if the pressure at the top of casing 11 is 400 psi, and the pressure at the top of tubing 57 is 320 psi, then a hydrostatic head of liquid 85 exists equivalent to 80 psi. This liquid column might extend to 100 feet or so above plunger 59. These pressure differentials can be used to calculate the amount of liquid in tubing 57.

Figure 5:
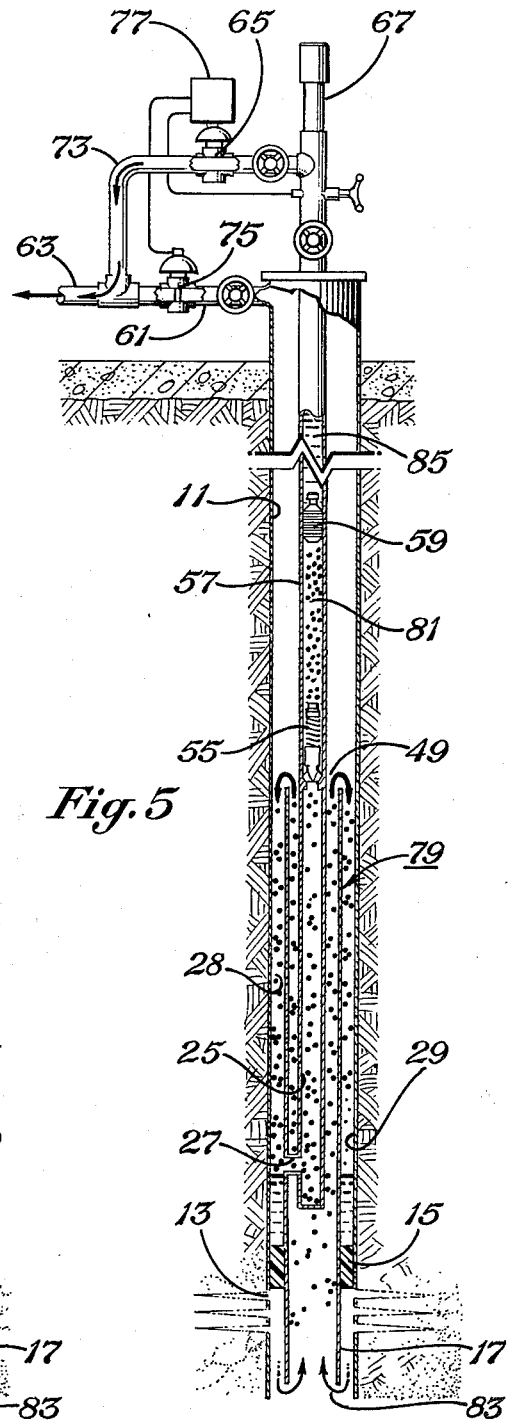
FIG. 5 is a schematic in reduced scale of the system of FIG. 1, further simplified and shown in the liquid producing mode.

After a selected time for formation pressure build-up has past, the tubing valve 65 is opened, while the casing valve 75 remains closed, as shown in FIG. 5. The formation pressure need not be fully built up, but should be sufficient to move the liquid 85 to the sales line 63. That is, the casing 11 pressure less the sales line 63 pressure should exceed the hydrostatic pressure due to the height of the column of liquid 85. The time for opening tubing valve 65 may be empirically determined and set by a timer. The time duration for build-up may be from a few minutes to several hours. Also, pressure differential switches between the casing 11 and tubing 57 could indicate the liquid column hydrostatic pressure, and trigger the opening of tubing valve 65 once the differential has reached a selected amount. Also, the pressure in the casing 11 could trigger the opening of tubing valve 65 once the pressure has reached a selected value.

Once the tubing 57 is opened to the sales line 63 pressure, the tubing 57 pressure at the top drops quickly to the sales line 63 pressure. The higher build-up pressure in casing 11 drives the column of liquid 85 upward into the sales line 63. Additional fluid from the formation will be produced through perforations 13, as well. The high velocity flow causes the plunger 59 to move upward at a high rate of speed, it being the interface between the gas entering the tubing 57 and the liquid column 85 above the plunger. Plunger 59 prevents the gas from breaking through the liquid 85 in a large slug.

Once plunger 59 reaches the top of lubricator 67, it closes port 71 (FIG. 1*a*), closing off tubing 57 flow. The control circuit 77 senses the differential between the higher pressure in tubing 57 below plunger 59, and the lower pressure in sales line 63. This differential causes the control circuit 77 to signal valve 75 to open the casing 11 to the sales line 63. Gas will commence to flow from casing 11 into the sales line 63, fairly quickly dropping to the sales line 63 pressure. The pressure at the lower end of tubing 57 will also drop to the sales line 63 pressure. The plunger 59 will then have the same pressure above and below it, thus will drop by gravity to bumper spring 55. The cycle will be repeated as often as is necessary to remove accumulated liquid.

The standpipe 79 and packer 15 serve as isolation means for isolating the perforations 13 from the accumulated liquid 85. If there is sufficient casing 11 depth below perforations 13, however, this portion of casing 11 could serve as isolation means, and the packer 15 and standpipe 79 could be eliminated. If so, the tubing 57 lower end would be open and would extend into the liquid at the bottom of the casing 11. Plunger 59 would be located close to the bottom of tubing 57.

Valves 65 and 75, lubricator 67, and control circuit 77 serve as valve means for selectively opening and closing the tubing 57 in casing 11 to the sales line 63. The annular area between standpipe 79 and casing 11 serves as collection means for collecting liquid that drops from the fluid flow. The flow path 29 in standpipe 79 serves as restriction means for restricting the cross-sectional area of the flow path for the produced fluid for a selected distance.

It should be apparent that an invention having significant advantages has been provided. The liquid removal system allows accumulated liquid to be produced from gas producing wells without the need for a low pressure system on the surface. The system also isolates the perforations from accumulated liquid, even if there is insufficient hole depth below the perforations. The isolation means avoids forcing the liquids back into the formation during casing gas pressure build-up. The system utilizes the energy of the well created by formation pressure build-up to produce the liquid.

While the invention has been shown in only one of its forms, it should be apparent that it is not so limited but is susceptible to various modifications and changes thereof.

I claim:

1. A method of removing accumulated liquid from a well that is producing liquid and gas, the well being of the type having a casing with perforations at a producing formation, the casing being connected at its top to a sales line for producing gas and having a string of tubing located therewithin, the method comprising:

connecting the top of the tubing to the sales line, the lower end of the tubing being in communication with the accumulated liquid;

opening the casing to the sales line, allowing the accumulated liquid to collect in the casing and the tubing as the gas is produced; then closing both the tubing and the casing at the sales line, allowing pressure to build up in the casing, and forcing the accumulated liquid in the tubing upward; then opening the tubing only to the sales line, allowing pressure in the casing to force the accumulated liquid in the tubing into the sales line; then opening the casing also to the sales line to cause gas to again flow from the casing to the sales line.

2. A method of removing accumulated liquid from a well that is producing liquid and gas, the well being of the type having a casing with perforations at a producing formation, the casing being connected to a sales line for producing gas and having a string of tubing located within, the method comprising:

connecting the top of the tubing to the sales line, the lower end of the tubing being in communication with the accumulated liquid;

providing a restriction means above the perforations for a selected distance to receive all of the upward flow from the perforations and restrict its flow path to increase its velocity;

providing a collection means for collecting liquid that drops from the flow in the casing after passing through the restriction means, and for isolating the collected liquid from the perforations and communicating it with the tubing;

opening both the tubing and the casing to the sales line, allowing fluid from the perforations to flow up the restriction means and into the casing, with the gas proceeding to the sales line and liquid dropping into the collection means, and then flowing into the tubing;

closing both the tubing and the casing at the sales line, allowing formation pressure to build up in the casing, and forcing the accumulated liquid in the tubing upward; then opening the tubing only to the sales line, allowing pressure in the casing to force the accumulated liquid in the tubing into the sales line; then opening the casing also to the sales line to cause gas to again flow from the casing to the sales line.

3. In a well of the type having casing with perforations in a producing formation, the casing being connected at its top to a sales line for producing gas, an improved system for removing accumulated liquid from the well, comprising:

an open-ended standpipe of length substantially less than the depth of the well, mounted within the casing by a packer located above the perforations, defining a collection chamber between the standpipe and the casing above the packer for the accumulated liquid;

a string of tubing mounted in the casing, the tubing having a lower end located inside the standpipe that is closed to fluid flowing from the perforations up the standpipe, defining a flow path between the tubing and the standpipe for the fluid flowing from the perforations, the lower end of the tubing being in communication with the collection chamber by a passage, the top of the tubing being connected to the sales line;

a plunger located inside the tubing and reciprocal between a lower position adjacent the standpipe and an upper position at the top of the tubing; and valve means for selectively opening and closing the casing and the tubing to the sales line.

4. In a well of the type having casing with perforations in a producing formation, the casing being connected at its top to a sales line for producing gas, an improved system for removing accumulated liquid from the well, comprising:

an open-ended standpipe of length substantially less than the depth of the well, mounted within the casing by a packer located above the perforations, defining a collection chamber between the standpipe and the casing above the packer for the accumulated liquid;

a string of tubing mounted in the casing, the tubing having a lower end located inside the standpipe that is closed to fluid flowing from the perforations up the standpipe, defining a flow path between the tubing and the standpipe for the fluid flowing from the perforations, the lower end of the tubing being in communication with the collection chamber by a passage, the top of the tubing being connected to the sales line;

a plunger located inside the tubing and reciprocal between a lower position adjacent the standpipe and an upper position at the top of the tubing; and a lubricator at the top of the well for receiving the plunger, the lubricator having a port communicating the tubing with the sales line, the port adapted to be closed by the plunger when the plunger is located in the lubricator; and control means for sensing when the plunger has closed the port and for opening the casing to the sales line when this occurs.

5. A method of removing accumulated liquid from a well that is producing liquid and gas, the well being of the type having a casing with perforations at a producing formation, the casing being connected to a sales line for producing gas and having a string of tubing located within, the method comprising:

connecting the top of the tubing to the sales line, the lower end of the tubing being in communication with the accumulated liquid;

providing a restriction means above the perforations for a selected distance to receive all of the upward flow from the perforations and restrict its flow path to increase its velocity;

providing a collection means for collecting liquid that drops from the flow in the casing after passing through the restriction means, and for isolating the collected liquid from the perforations and communicating it with the tubing;

opening the casing to the sales line, allowing fluid from the perforations to flow up the restriction means and into the casing, with the gas proceeding to the sales line and liquid dropping into the collection means, and then flowing into the tubing;

closing both the tubing and the casing at the sales line, allowing formation pressure to build up in the casing, and forcing the accumulated liquid in the tubing upward, then opening the tubing only to the sales line, allowing pressure in the casing to force the accumulated liquid in the tubing into the sales line; then opening the casing also to the sales line to cause gas to again flow from the casing to the sales line.

* * * * *